US005161317A

United States Patent [19]

McDougall

[11] Patent Number: 5,161,317

[45] Date of Patent: Nov. 10, 1992

[54] HAIR DRYER ATTACHMENT

[75] Inventor: Gregory J. McDougall, San Po Kong, Hong Kong

[73] Assignee: Asia World Trade Limited, The Bahamas

[21] Appl. No.: 793,111

[22] Filed: Nov. 18, 1991

[51] Int. Cl.[5] ..... A45D 20/00

[52] U.S. Cl. ..... 34/97; 239/383

[58] Field of Search ..... 34/97, 96, 99, 91, 90; 392/380, 397, 379, 383; 239/383

[56] References Cited

U.S. PATENT DOCUMENTS

| | | | |
|---|---|---|---|
| 4,132,360 | 1/1979 | Lee, Jr. | 239/383 |
| 4,295,283 | 10/1981 | Tomaro | 34/97 |
| 4,878,620 | 11/1989 | Tarleton | 239/383 |
| 5,054,211 | 10/1991 | Shulman | 34/97 |

FOREIGN PATENT DOCUMENTS

| | | |
|---|---|---|
| 0284690A2 | 10/1988 | European Pat. Off. . |
| 0441752A1 | 8/1991 | European Pat. Off. . |
| 3225944A1 | 3/1983 | Fed. Rep. of Germany . |
| 2446615 | 8/1980 | France . |

*Primary Examiner*—Henry A. Bennet

*Attorney, Agent, or Firm*—Burns, Doane, Swecker & Mathis

[57] ABSTRACT

A hair dryer attachment includes a rotor impeller for converting a uniform stream of air from the hair dryer into a pulsating stream of air. A governor is provided on the rotor impeller or reduction gearing is provided between the rotor and the impeller to reduce the speed of rotation so that the pulsations are at a frequency perceptible to the user.

5 Claims, 5 Drawing Sheets

HAIR DRYER ATTACHMENT

FIELD OF THE INVENTION

The present invention relates to attachments for conventional hand held electrically powered pistol type hair dryers so as to enable such hair dryers to deliver a pulsating stream of air.

PRIOR ART

Examples of such attachments are described in U.S. Pat. No. 4,132,360 to Lee, published German Patent Application DE 3 225 944 A1, and published European Patent Application EP 0 441 752 A1.

The attachment described in U.S. Pat. No. 4,132,360, suffers from the disadvantage that it would not adequately and sufficiently modify the uniform air stream from the blower mechanism of the hair dryer to a pulsating air stream. The simple light weight impeller rotor described would rotate at a frequency so high that the pulsations would be barely perceptible to the user. However, if the rotor impeller were made heavier so as to rotate more slowly, then this would require a blower mechanism of substantially greater power to initiate rotation of the heavier rotor impeller and to maintain the heavier rotor impeller in rotation, and this would involve a bulkier hair dryer, greater electricity consumption, and the risk of over-heating due to air back pressure. In addition, the pulsation produced arises because the rotor is mounted in an unbalanced fashion, and these pulsations would be transmitted to the hairdryer housing in the form of vibrations which would make it uncomfortable for a user to hold the hair dryer for any prolonged length of time.

EP 0 441 752 describes an attachment in which the frequency of rotation of the impeller rotor may be reduced. This reduction is achieved by venting some of the air stream through side outlets and is thus an unsatisfactory solution, as a useful reduction in speed can be attained only by venting a large proportion of the useful air.

OBJECT OF THE INVENTION

An object of the present invention is to provide an attachment which includes an impeller rotor which rotates at a sufficiently low frequency that the pulsation is clearly perceptible to the user, a frequency of 400 to 900 revolutions per minute being suitable. The rotor impeller should be of sufficiently light weight construction so that rotation can be initiated and maintained by the blower mechanism of a conventional electric hair dryer. All of the air produced by the hair dryer should be available to dry the hair.

SUMMARY OF THE INVENTION

In one aspect of the invention this object is achieved by including a governor mechanism for limiting the speed of rotation of the rotor impeller mechanism.

In another aspect of the invention this object is achieved by provision of a separate impeller and rotor connected by means of reduction gearing, so that as the impeller is driven in rotation at a relatively high speed, the rotor rotates at a lower speed producing pulsations at the lower speed.

DETAILED PRESCRIPTION OF THE PREFERRED EMBODIMENTS

Figure 1:
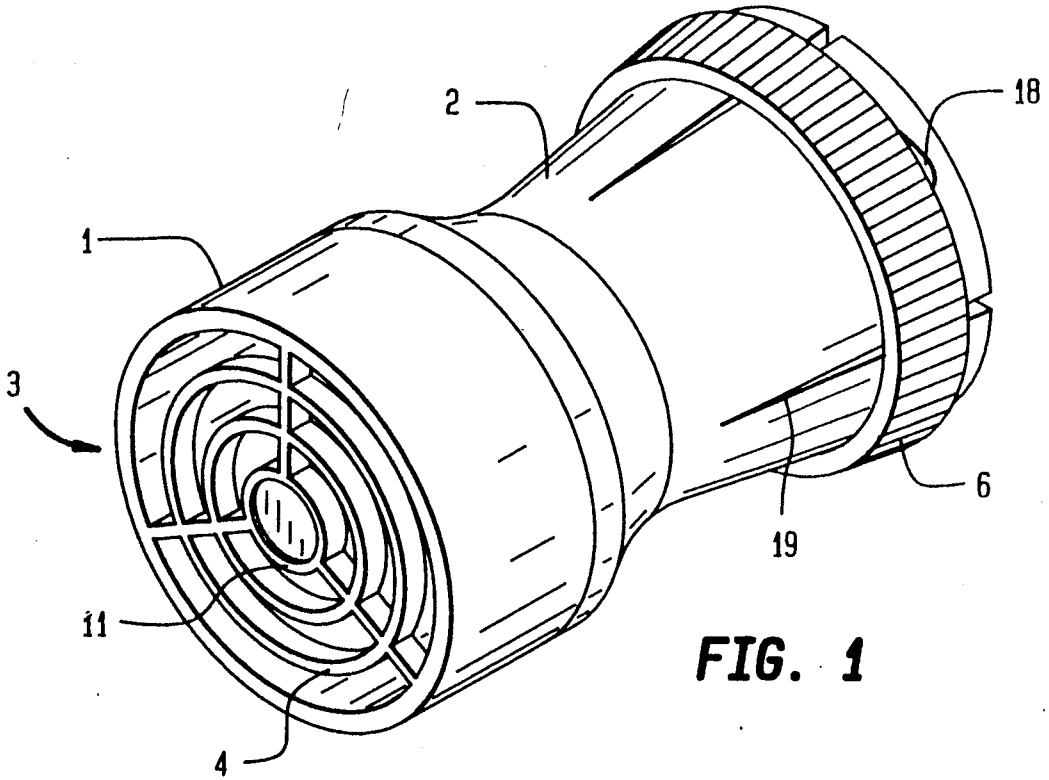
FIG. 1 is a perspective view of a first embodiment of attachment.
Figure 5:
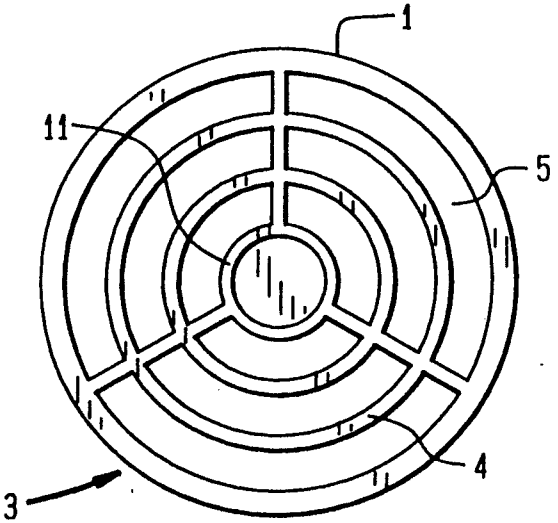
FIG. 5 is an end-on view of the first embodiment.
Figure 6:
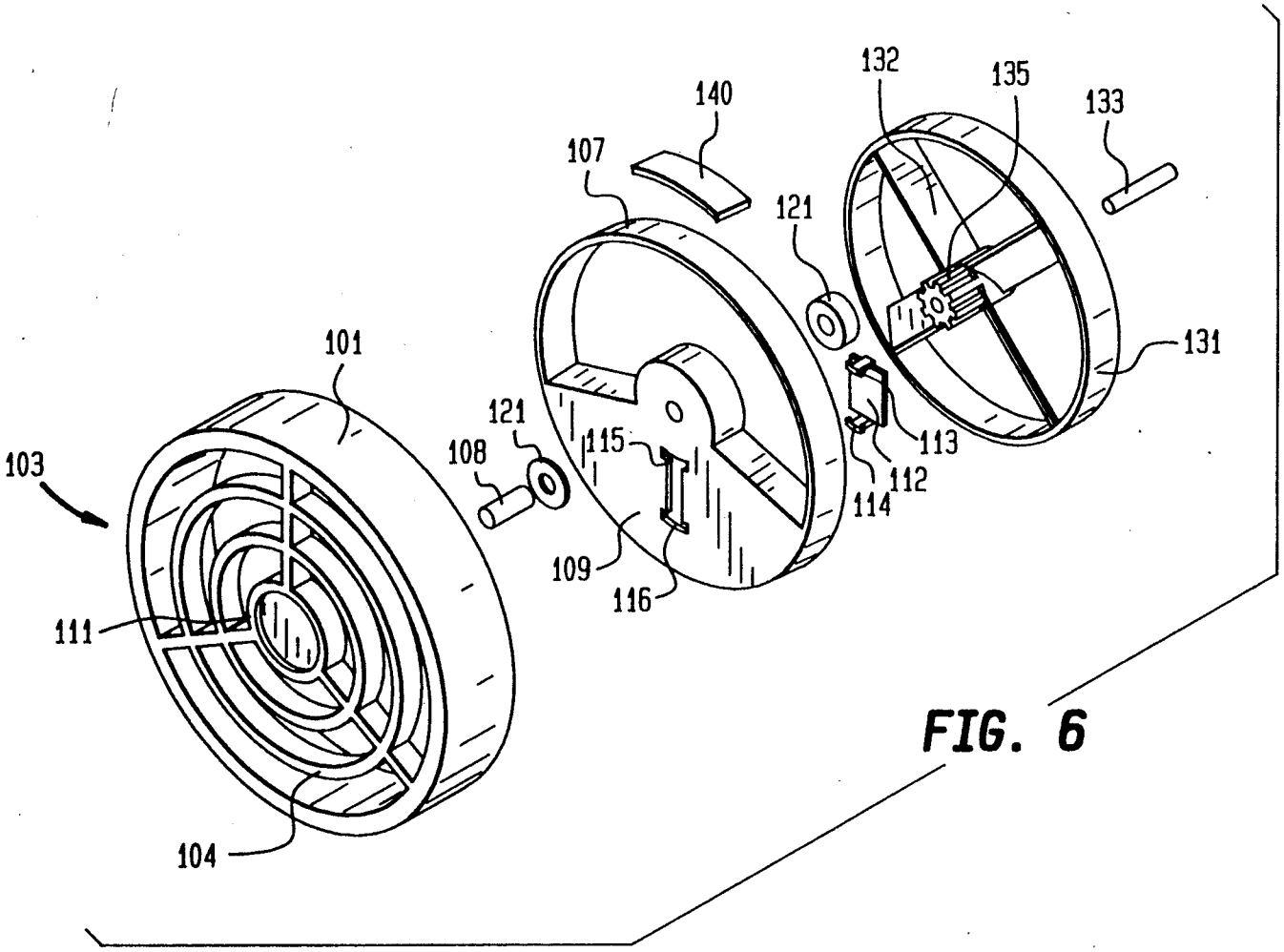
FIG. 6 is an exploded perspective view of a second embodiment.
Figure 8:
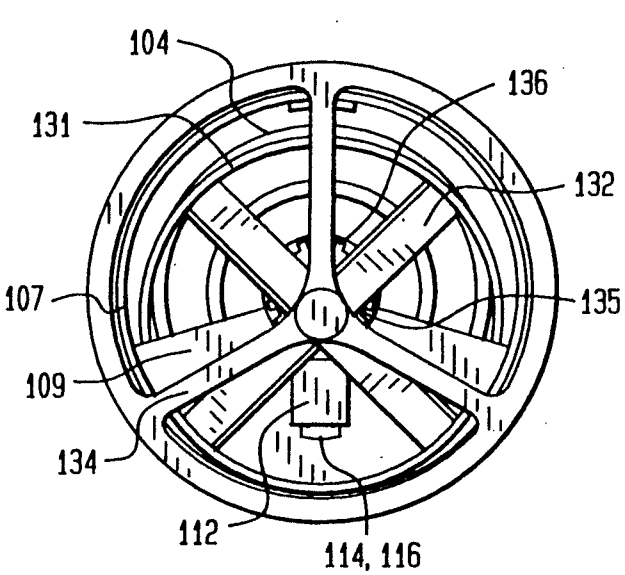
FIG. 8 is an end elevation from the other end.
Figure 9:
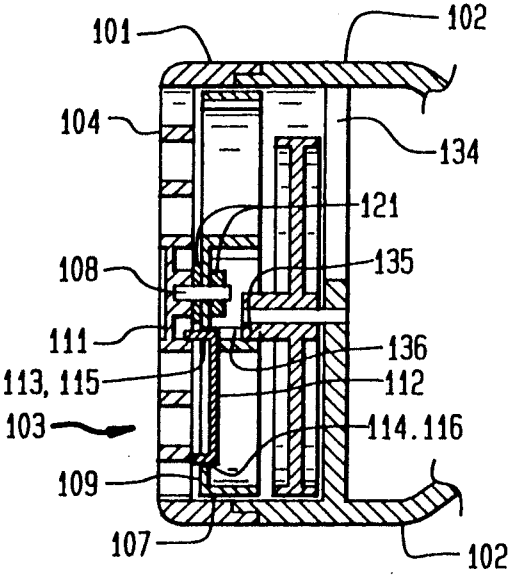
FIG. 9 is a sectional side elevation thereof.
Figure 7:
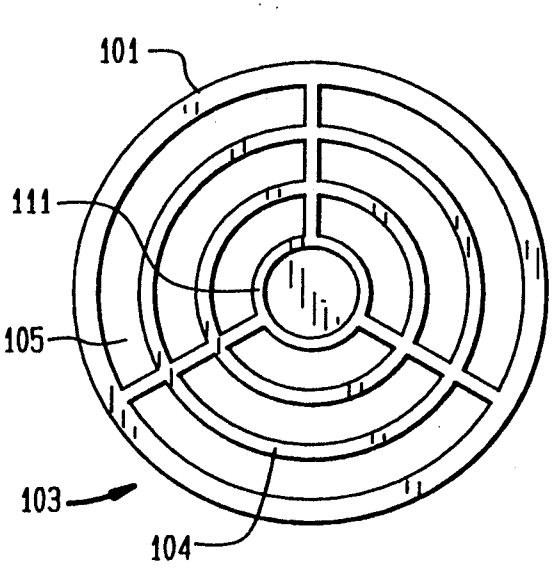
FIG. 7 is an end elevation of the second embodiment from one end thereof.

Reference is made initially to FIG. 1. The attachment comprises a housing consisting of two parts, namely a hollow cylindrical drum 1 which houses the rotor impeller and the governor, and a flared skirt 2. The nozzle 3 of the drum 1 is provided with an open frame 4 which supports a sheet of gauze 5 (shown only in FIG. 5). The flared skirt 2 is provided with a manually rotatable collar 6 for use in tightening the skirt 2 onto the nozzle of a hair dryer.

Still referring to FIG. 1, in use of the attachment the flared skirt 2 is fitted over the nozzle of a conventional hair dryer (not shown in the drawings) and the collar 6 is rotated to lock the attachment in position. The hair dryer is then operated in the conventional manner. The uniform stream of air emerging from the nozzle of the hair dryer is converted by the attachment into a pulsating stream of air.

Figure 3:
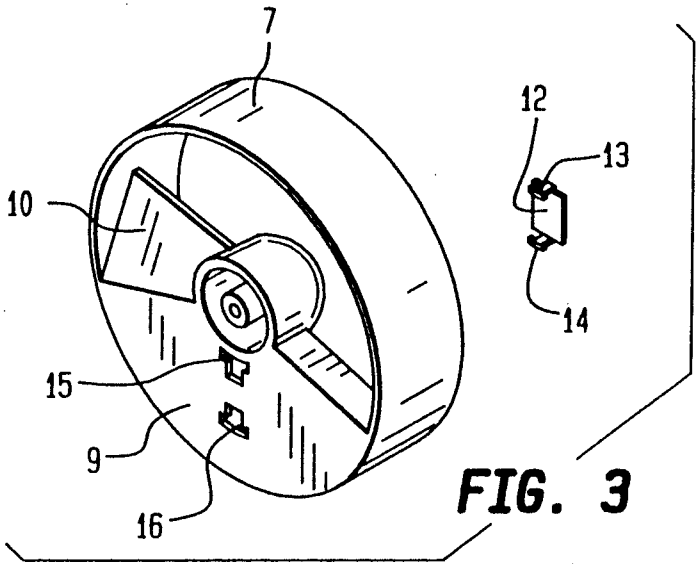
FIG. 3 shows a detail of FIG. 2 from a slightly different perspective.
Figure 2:
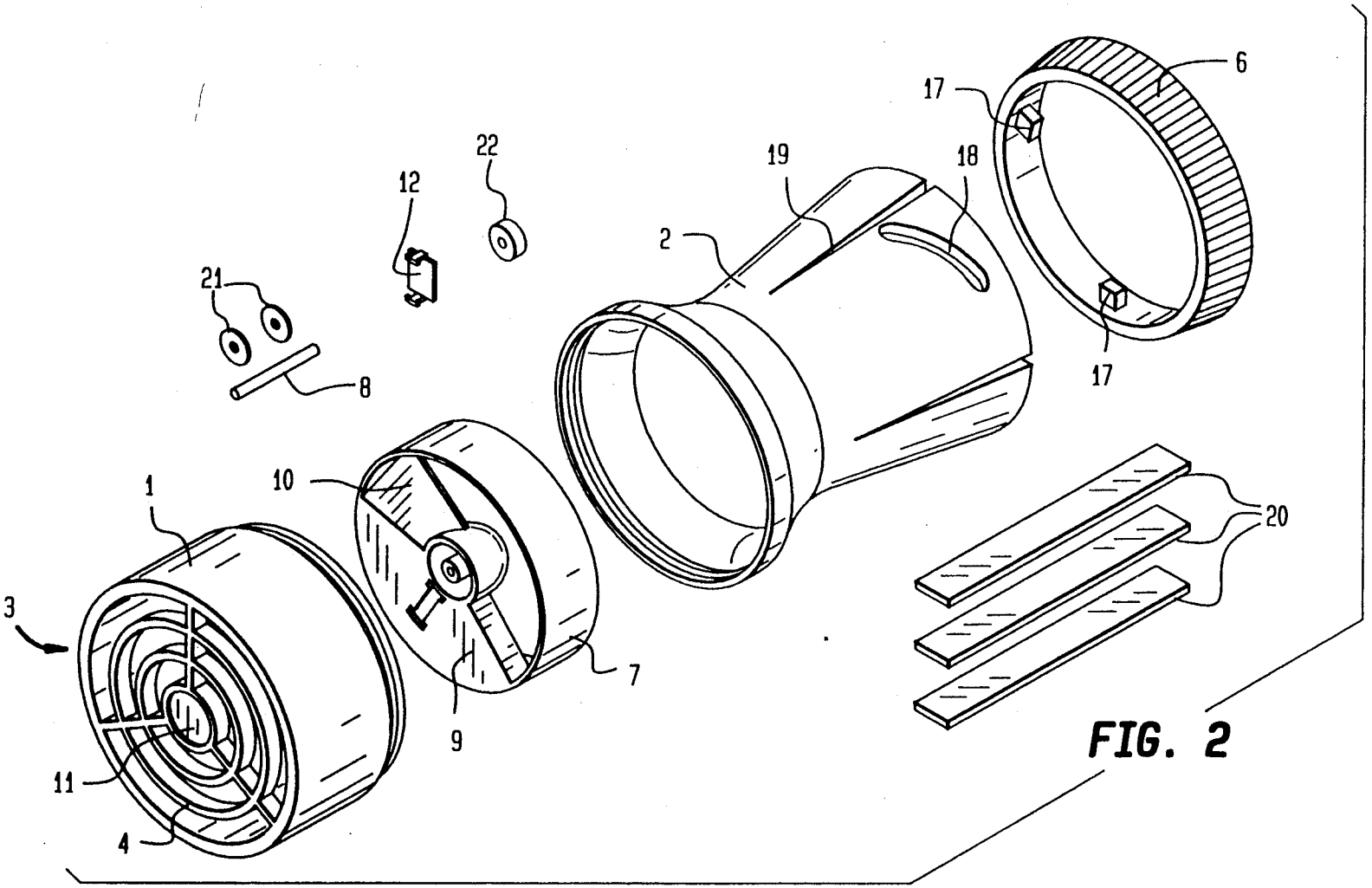
FIG. 2 is an exploded perspective view of the first embodiment.

Referring now to FIGS. 2 and 3, the rotor impeller will now be described. The rotor impeller consists essentially of a collar 7 mounted on a spindle 8 which is supported by the open frame 4. The collar 7 includes a planar baffle 9 extending perpendicularly to the axis of the attachment across part of the diameter of the collar 7, with a fixed flap 10 inclined in the direction of the flared skirt 2. In use a uniform stream of air flows from the hair dryer nozzle, through the flared skirt 2, and impacts against the rotor impeller 7, 9, 10. The impact of the stream of air on the inclined flap 10 causes the rotor impeller 7, 9, 10 to rotate. The impact of the stream of hair on the planar baffle 9 causes a proportion of the air to be blocked. The overall result is the rotation of the rotor impeller 7, 9, 10 and the release of a stream of air which pulsates with a frequency equal to the frequency of rotation of the rotor impeller 7, 9, 10. When use commences the rotor impeller 7, 9, 10 gradually picks up speed. Because of its light weight construction and freely rotatable mounting the frequency of rotation of the rotor impeller 7, 9, 10 would eventually rise, if not constrained, to a frequency at which the pulsation of the air would be barely discernible to the user. Still referring to FIGS. 2 and 3, the governor will now be described. The governor consists essentially of two components, namely a small collar 11 located at the centre of the open frame 4, and a weight 12 mounted on the rear face of the planar baffle 9 so as to be freely slidable radially inwardly and outwardly along the surface of the baffle 9. As best seen in FIG. 3, the slidable mounting is achieved by means of a pair of neck and head arrangements 13, 14, one at each end of the weight 12 which project through a corresponding pair of approximately keyhole shaped slots 15, 16 in the planar baffle 9. The mutual separation of the wide parts of the keyhold shaped slots 15, 16 is greater than the mutual separation of the neck and head arrangements 13, 14.

In use, as the rotor impeller 7, 9, 10 rotates, centrifugal force causes the weight 12 to move radially outwardly. As the frequency of rotation increases, the weight 12 slides radially outwardly to the extent that the head 13 at the radially inward end of the weight 12 bears against the inside wall of the small collar 11. As the speed of rotation increases still further, the head 13 bears with increasing force against the inside wall of the collar 11, and the resulting frictional force limits the speed of rotation of the rotor impeller 7, 9, 10.

The illustrated embodiment has been tested in connection with a conventional commercially available hair dryer in which the motor of the blower mechanism rotates at 10,500 revolutions per minute. With the weight 12 removed the rotor impeller 7, 9, 10 rotated at a speed of approximately 1,500 revolutions per minute. With the weight 12 in position the speed was reduced to approximately 600 revolutions per minute.

Because different commercially available hair dryers deliver streams of air at different volumes and speeds, it is desirable that the speed reduction should be variable. This may be achieved by using weights 12 of different weight, or by varying the radial location of the weight 12.

Figure 4:
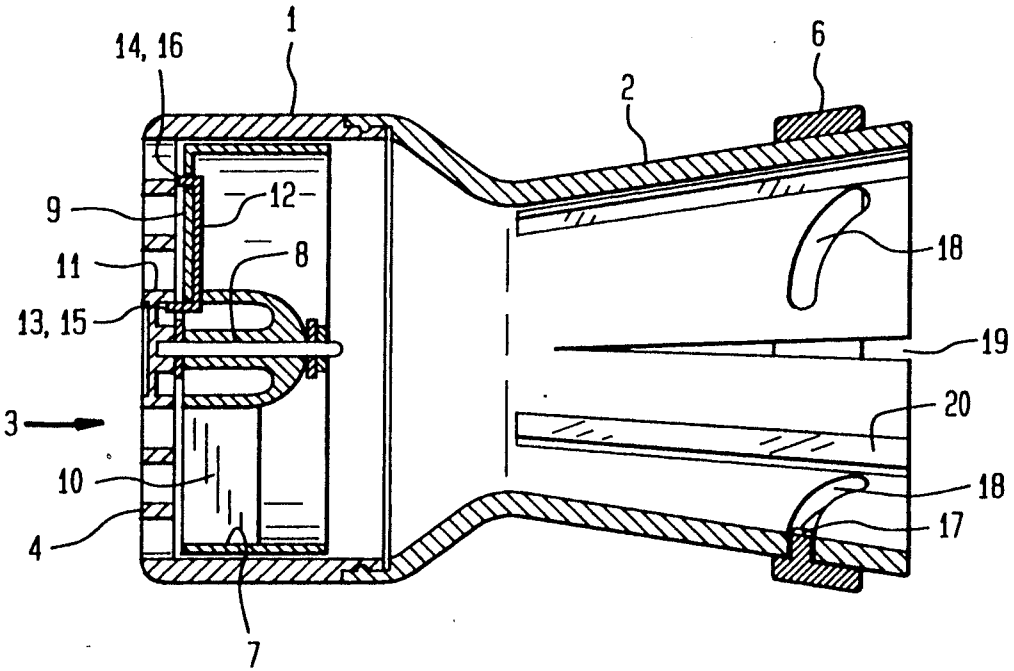
FIG. 4 is a cross sectional view of the first embodiment.

Referring now to FIGS. 1, 2 and 4 the mechanism for securing the attachment to the nozzle of a hair dryer will now be described. The manually rotatable collar 6 has three internally projecting lugs 17 which cooperate with three corresponding helical grooves 18 on the flared skirt 2. As the collar 6 is rotated it moves axially along the length of the flared skirt 2. Axial movement of the collar 6 in the direction of the nozzle of the hair dryer causes the diameter of the flared skirt 2 to decrease, with the lengthwise slits 19 gradually closing, so that the flared skirt 2 tightens onto the nozzle. To prevent damage to the nozzle the flared skirt 2 is provided on the inside surface thereof with a number of protective rubber strips 20.

Also shown in FIG. 2 are washers 21 and bushing 22 for mounting the rotor impeller 7, 9, 10 on the spindle 8.

Reference is now made to FIGS. 6, 7, 8 and 9. The second embodiment is similar to the first except that the arrangement for driving the rotor impeller in rotation is different. In the first embodiment the rotor impeller is driven in rotation by the impact of the air stream on the inclined flap 10 which is formed integrally with the planar baffle 9. In the second embodiment the inclined flap is omitted and is replaced by a separate impeller comprising a collar 131 and four blades 132. This impeller 131, 132 is mounted on spindle 133, which is journalled eccentrically in open frame 134 which is housed within the flared skirt. The drive from the impeller 131, 132 is transmitted to the baffle 109 by reduction gearing consisting of a gear 135 on the impeller 131, 132 meshing with a gear 136 housed within collar 107 at the centre of the baffle 109.

Other components shown in the drawings are a drum 101, flared skirt 102, nozzle 103, open frame 104, gauze sheet 105, collar 107, spindle 108, small collar 111, weight 112, neck and head arrangements 113, 114, keyhole shaped slots 115, 116 and washers 121, and these components serve the same functions as in the first embodiment. Also shown is a weight 140 to balance the collar 107. The second embodiment includes both a governor and reduction gearing. However, no governor is necessary if the reduction ratio is sufficient.

I claim:

1. An attachment for use with a hair dryer comprising: an attachment mechanism; a rotor impeller which, when in use with the hair dryer, is driven in rotation by the stream of air from the hair dryer and converts the uniform stream of air to a pulsating stream of air; and a governor associated with the rotor impeller for limiting the speed of rotation of the rotor impeller below that which would otherwise be attained without said governor.

2. An attachment in accordance with claim 1 in which the rotor impeller comprises a collar mounted within the attachment, so as to be freely rotatable about an axis aligned with the direction of air flow, an inclined vane extending across part of the collar aperture such that air impacting on the vane drives the collar in rotation, and a baffle plate extending across a substantial part of the collar aperture.

3. An attachment in accordance with claim 1 in which the rotor impeller comprises a collar mounted within the attachment so as to be freely rotatable about an axis aligned with the direction of air flow, at least one inclined vane extending across the collar aperture such that air impacting on said at least one vane drives the collar in rotation, an additional collar mounted within the attachment so as to be freely rotatable about an axis aligned with the direction of air flow, a baffle plate extending across a substantial part of the aperture of the additional collar, and a drive transmission arrangement connecting the collar to the additional collar for transmitting the rotation of the collar to the additional collar.

4. An attachment according to claim 1 in which the governor comprises a weight mounted on a baffle plate of the impeller for slidable motion relative to the baffle plate in a radially inward or outward direction between radially inward and outward constraints and a plate on the weight for frictional engagement with a fixed part of the attachment when the weight is caused to move to the weight's radially outermost position under centrifugal force arising from rotation of the baffle plate.

5. An attachment for use with a hair dryer comprising: an attachment mechanism; an impeller which, when in use with the hair dryer, is driven in rotation by the stream of air from the hair dryer; a rotor including a baffle for converting the uniform stream of air to a pulsating stream; and reduction gearing connecting the rotor to the impeller so that the rotor rotates at a lower speed than the impeller.

* * * * *